US005666693A

United States Patent [19]

Levay

[11] Patent Number: 5,666,693

[45] Date of Patent: Sep. 16, 1997

[54] TOY HANDLE FOR ORAL DEVICE

[75] Inventor: Peggy Levay, Leesburg, Va.

[73] Assignee: Cap Toys, Bedford Heights, Ohio

[21] Appl. No.: 528,773

[22] Filed: Sep. 15, 1995

[51] Int. Cl.[6] ..... A47B 95/02

[52] U.S. Cl. ..... 16/114 R; 16/DIG. 24

[58] Field of Search ..... 16/114 R, 111 R, 16/DIG. 12, DIG. 18, DIG. 19, 121; 294/87.11; 606/234, 235, 236; D8/305; D1/107, 110, 111; D21/121, 148, 158, 188; D19/53, 54; D24/194, 195–199; 81/177.1; 30/340

[56] References Cited

U.S. PATENT DOCUMENTS

| | | | |
|---|---|---|---|
| D. 43,919 | 4/1913 | Bridges . | |
| D. 74,251 | 10/1928 | Bettoli . | |
| 122,650 | 1/1872 | Roth . | |
| D. 145,611 | 9/1946 | Butterfield | D24/199 |
| D. 158,606 | 8/1950 | McCloskey et al. . | |
| D. 161,353 | 12/1950 | Mann . | |
| D. 179,215 | 11/1956 | Prisament . | |
| D. 269,461 | 6/1983 | Qually . | |
| D. 269,462 | 6/1983 | Qually . | |
| D. 269,815 | 7/1983 | Qually . | |
| D. 271,052 | 10/1983 | Qually . | |
| 297,134 | 4/1884 | Keller et al. . | |
| D. 303,431 | 9/1989 | Brown . | |
| D. 305,346 | 1/1990 | Roberts | D24/199 |
| D. 312,877 | 12/1990 | Flores . | |
| D. 316,568 | 4/1991 | Koch . | |
| D. 318,731 | 7/1991 | Chapin . | |
| D. 318,921 | 8/1991 | Chapin . | |
| D. 321,938 | 11/1991 | Burt | D24/199 |
| D. 326,158 | 5/1992 | Katz et al. . | |
| D. 331,628 | 12/1992 | Dodson et al. . | |
| 1,154,633 | 9/1915 | Hoberg . | |
| 1,668,524 | 5/1928 | Bogue . | |
| 1,936,816 | 3/1933 | Zitzman . | |
| 2,860,639 | 11/1958 | Hoover | D24/195 |
| 2,964,872 | 4/1960 | Coleman . | |
| 3,037,783 | 6/1962 | Schlidt et al. | 16/114 R |
| 3,256,031 | 6/1966 | Fillweber | 16/114 R |
| 3,742,602 | 7/1973 | Brumwell | 30/340 |
| 3,912,140 | 10/1975 | Franges | 16/114 R |
| 4,071,063 | 1/1978 | Russell | 16/114 R |
| 4,277,910 | 7/1981 | Kramer | 606/234 |
| 4,283,808 | 8/1981 | Beebe | 16/114 R |
| 4,567,616 | 2/1986 | Lyons | 16/116 R |
| 4,876,766 | 10/1989 | Cohen | 16/114 R |
| 5,115,530 | 5/1992 | Distiso | 16/114 R |

*Primary Examiner*—Chuck Y. Mah
*Attorney, Agent, or Firm*—Bliss McGlynn, P.C.

[57] ABSTRACT

A novelty device simulating a portion of a character or an object, such as half of an animal, for example a frog, is capable of functioning as a toy handle for use with oral devices such as lollipops, popsicles or teething rings or the like, which are typically placed in the mouth of the user and provided with a handle allowing periodic removal. The amusement device allows interactive response between the user and the toy handle, as well as between the user and observers, evoking a surprised, humorous reaction in the observer. The toy handle has securing structure disposed within a receiving channel of the main body of the toy handle such that the typical handle of such an oral device may be selectively and removably secured within the toy handle. Where the handle of the oral device is a typical wrapped paper handle for a lollipop, the securing structure may be a frustoconically shaped threaded channel such as used with a wire nut, to deform and thus secure the paper lollipop handle in the toy handle of the present invention. Alternative securing structure are also disclosed.

10 Claims, 3 Drawing Sheets

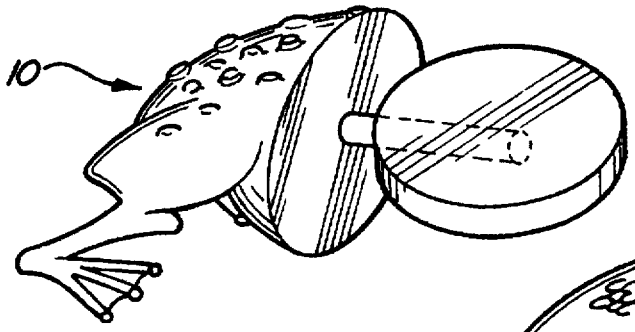
Fig - 1A
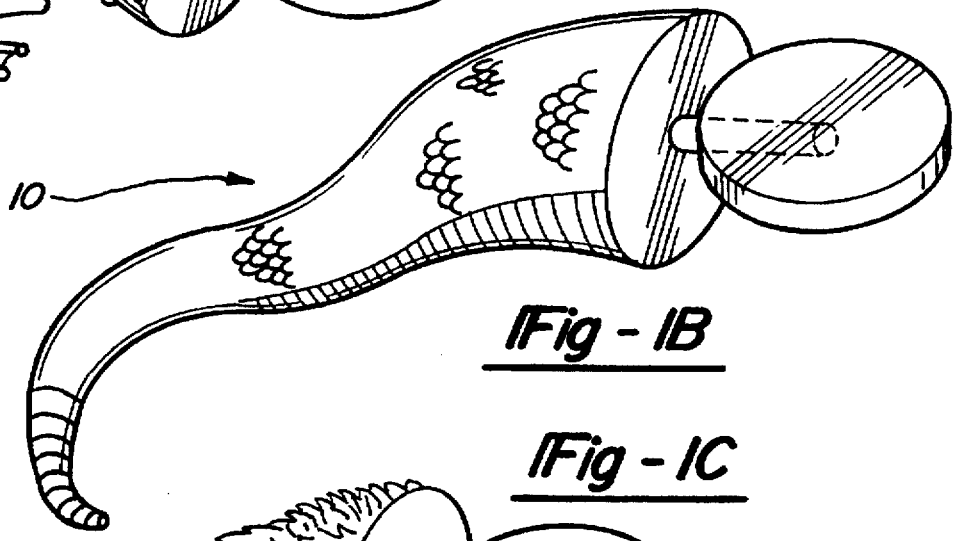
Fig - 1B
Fig - 1C
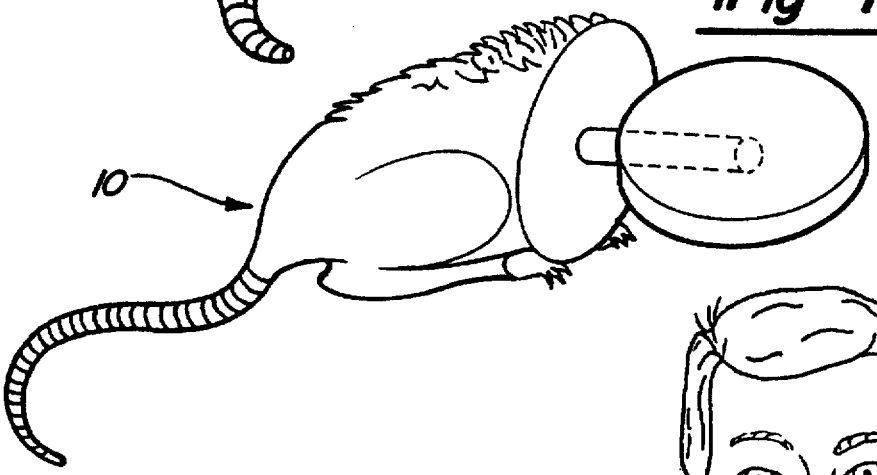
Fig - 2
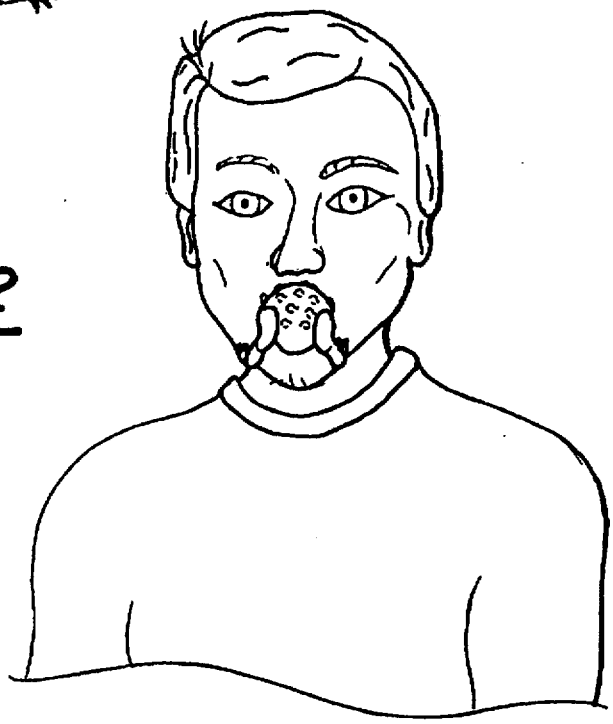

TOY HANDLE FOR ORAL DEVICE

BACKGROUND OF THE INVENTION

1. Technical Field

The invention relates to an amusement device, namely a toy handle for an oral device such as a lollipop, popsicle, or infant pacifier which are periodically placed in and removed from the mouth of a user by means of a handle. More particularly, the toy handle of the present invention simulates a portion of a character or object such that the individual eating the confection appears to be swallowing the simulated character or object.

2. Description of Related Art

Handles on devices intended to be placed in the mouth of an individual are typically functional and of mundane, commonplace design. Thus, for example, lollipops are typically provided with a cylindrical handle made of wrapped paper, popsicles are placed on flat sticks, and pacifiers are provided with rings.

The prior art does occasionally show teething devices and baby bottles which are shaped to simulate an animal. For example, design patent 74,251 to Bettoli discloses a nursing bottle in the shape of a bunny rabbit and design patent 158,606 to McCloskey et al. shows a teething device in the shape of the head of an elephant, the trunk forming a circle which is the portion intended to be placed in the baby's mouth. Other designs show baby bottles shaped as portions of musical instruments.

All of these devices are fundamentally non-interactive for the user, providing visual amusement only for observers who come into contact with a child using one of the devices.

SUMMARY OF THE INVENTION

The subject invention aims to provide a novelty device expected not only to appeal to infants of an age who still use teething rings and nursing bottles, or to their parents, but also to children beyond such an age. Thus the novelty device of the present invention is aimed at simulating a portion of a character or object, for example an animal such as a frog or snake or the like. This toy handle is capable of use with oral devices such as lollipops, popsicles, and pacifiers or teething rings which are typically placed in the mouth with a pre-existing handle portion to allow periodic removal of the oral device during use.

The novelty attached to the present invention is that the character or object simulating toy handle, when placed in the mouth of the child, gives the impression that the child is in the act of swallowing the character or object. The amusement of the child using such a character or object simulating handle relates to the amusement, surprise and other reaction of observers seeing such a handle projecting from the mouth of the child.

The device of the subject invention is intended not only to be visually amusing to both the user and all observers, but also, regarding the lollipop/popsicle versions of the invention, are additionally meant to elicit interaction between the parties, as well as interaction between the device and the user. Specifically, they are designed as humorous devices to be employed by young and old to elicit a gag response from viewers. In order for the user to achieve the full desired effect on viewer/subjects, the user must employ imaginative play acting of consuming the character device; an act made easily achievable by the imaginative design of the subject invention.

While the invention is certainly capable of being a one-time use handle attached to the lollipop, popsicle, or other confection by connection to the pre-existing handle typical for that comestible, the invention also relates to a permanent reusable handle which can be repeatedly attached to a series of such confections. For use with non-comestible oral devices such as pacifiers or teething rings, the handle of the subject invention most commonly would be a permanently affixed handle, although a permanent, reusable handle capable of repeated attachment to the pre-existing handle of different oral devices certainly is possible as well. Accordingly, the invention also comprises mechanisms within the character or object simulating toy handles to allow selective attachment and detachment of current pre-existing or modified handles for oral devices.

BRIEF DESCRIPTION OF THE DRAWINGS

Other advantages of the present invention will be readily appreciated as the same becomes better understood by reference to the following detailed description when considered in connection with the accompanying drawings wherein:

FIGS. 1*a*, 1*b*, 1*c* are perspective views of three embodiments of the character or object simulating toy handle of the present invention, the view of FIGS. 1*a*, 1*b* and 1*c* showing toy handles simulating a frog, a snake and a rat, respectively.

FIG. 2 is perspective view of an embodiment of the invention in use, in the mouth of a child consumer.

DETAILED DESCRIPTION OF THE INVENTION

As shown in FIGS. 1*a*, 1*b*, and 1*c*, the subject invention provides a toy handle 10 for an oral device such as a lollipop, popsicle, or infant pacifier or teething ring in which the toy handle 10 simulates a portion of a character or an object. FIG. 2 shows the use of the simulating toy handle 10 with a lollipop in the mouth of a child. The amusement of the child and the observer relates to the surprise and humor of the unexpected impression that the child is in the act of swallowing the simulated character, such as an animal, or object.

Figure 3:
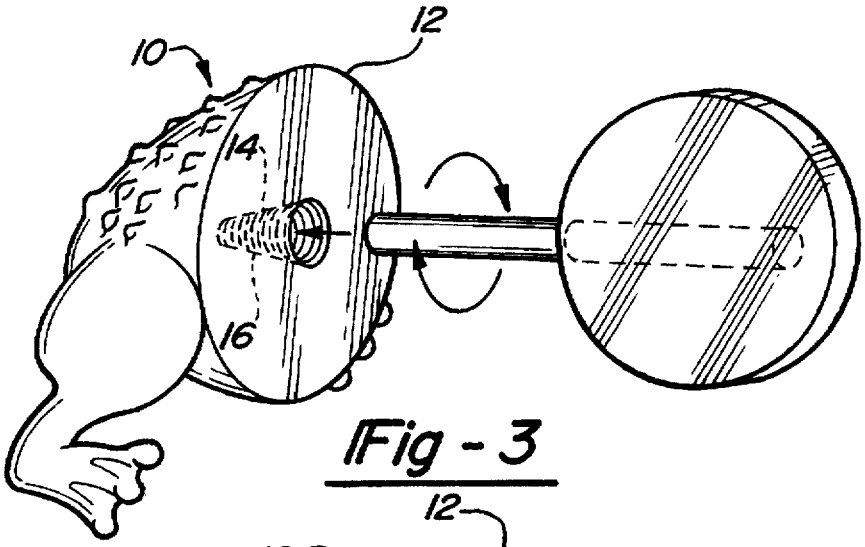
FIG. 3 is exploded, perspective view of an embodiment of the invention highlighting an attachment means for receipt and securing of the stick of an oral device which in this case is a lollipop.

FIG. 3 shows that the toy handle 10 includes a main body 12 which is formed into a shape simulating a portion of a character, in this case an animal. The handle 10 also comprises a receiving channel 14 disposed within main body 12. Receiving channel 14 has a securing means 16 disposed therein to secure the pre-existing handle end of an oral device, in this case a lollipop. In the embodiment shown in FIG. 3, securing means 16 comprises a frustoconically shaped, threaded interior circumference or bore similar to that used in a wire nut. Currently, a stick handle of tightly wound paper of the type is typically used with a lollipop and is capable of use with popsicles and other confections requiring handles. In operation with this embodiment, the paper stick handle of the lollipop or the like is placed within the threaded frustoconical section and rotated in proper direction to allow the threads to bite into the pliable paper handle thus securing the lollipop. After the lollipop or other confection is consumed, the paper handle is rotated in the proper direction to disengage the toy handle 10, which is then ready for repeated use.

As is evident from FIG. 3, the smaller frustoconical end is disposed at an interior end of receiving channel 14, i.e., the end distal from the oral device, so that as the paper handle is rotated into the threaded interior circumference of securing means 16 the free end of the lollipop stick is advanced into an ever tightening position to ensure that the toy handle 10 is adequately secured to the lollipop.

Figure 4:
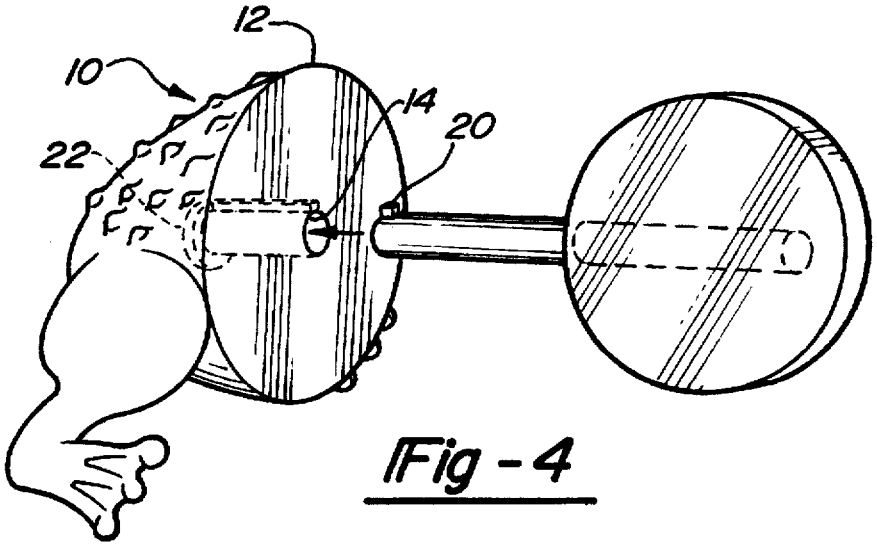
FIG. 4 is exploded, perspective view of another embodiment of the invention highlighting an attachment means for receipt and securing of the stick of an oral device which in this case is a lollipop.
Figure 5A:
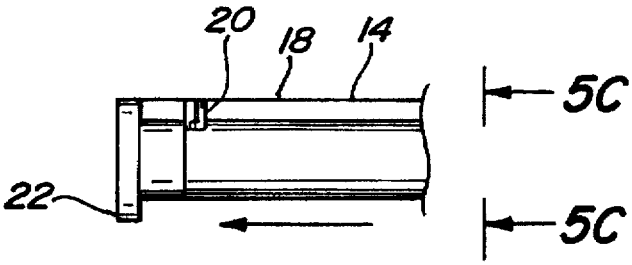
FIG. 5*a* shows a cross sectional view of the longitudinal bore, including the longitudinal groove while receiving channel 14, also illustrating the position of the lollipop handle, with locking tongue, while in the process of inserting the lollipop handle into the receiving channel.
Figure 5B:
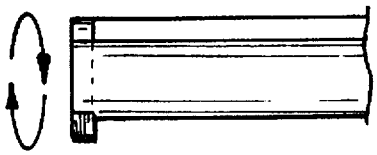
FIG. 5*b* shows the same cross sectional view as illustrated in FIG. 5*a*, except that the lollipop handle has been fully inserted into receiving channel 14, and rotated such that locking tongue 20 has been engaged within the open arcuate area 22 at the base of receiving channel 14.
Figure 5C:
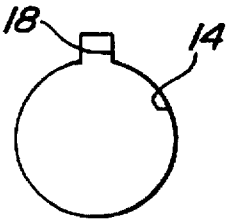
FIG. 5*c* shows a cross sectional view taken along line plane C—C of FIG. 5*a*, showing the keyhole type cross section presented by the longitudinal bore combined with the longitudinal groove 18, of receiving channel

FIG. 4 shows an alternative embodiment to securing means 16. In this embodiment, receiving channel 14 is a generally cylindrical longitudinal bore within main body 12 of handle 10. As best seen in the cross-sectional view of FIG. 5*c*, the longitudinal bore comprising receiving channel 14 further has a longitudinally extending groove 18 forming, in combination with the longitudinal bore, a keyhole cross sectional opening. This keyhole cross section of this embodiment of receiving channel 14 is adapted to receive a cylindrical pre-existing handle of the lollipop which has been modified by being provided with a locking tongue 20 at the free end (i.e., the non-candy end) of the lollipop handle. It should be noted that the base end of the bore comprising receiving channel 14 in this embodiment is provided with a cut out or open arcuate area 22 normal to the bore, which area may typically extend approximately 90° or more of the 360° circumference of the bore.

In operation, locking tongue 20 of the modified pre-existing handle of the lollipop is inserted into the keyhole shaped receiving channel 14 and advanced until the free end of the lollipop reaches the base of the bore comprising receiving channel 14. At this point, the pre-existing handle is rotated 90°, the locking tongue 20 thus rotating away from extending groove 18 within the open arcuate area 22. With the locking tongue 20 of the lollipop handle thus rotated away from groove 18 and into arcuate area 22, the lollipop handle is secured within main body 12 of the invention. To remove the lollipop handle once the confection has been consumed, the stick is rotated to again align the locking tongue 20 with groove 18 of receiving channel 14, and then is pulled out of main body 12.

Figure 6:
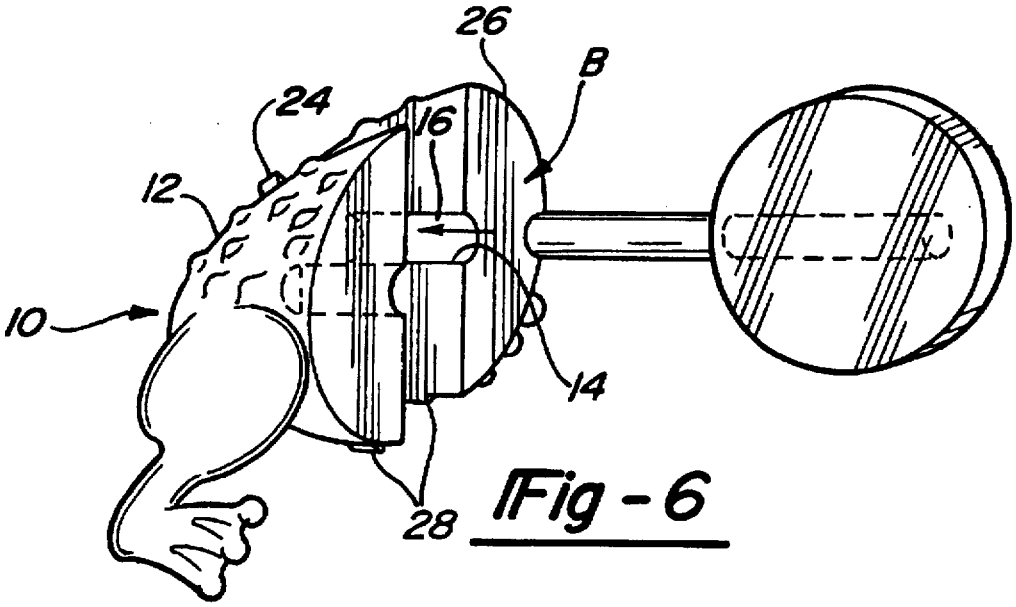
FIG. 6 is an exploded perspective view of an alternative embodiment of the invention in which the main body is formed of clampable halves and alternative securing means are disposed within the receiving channel 14.
Figure 7:
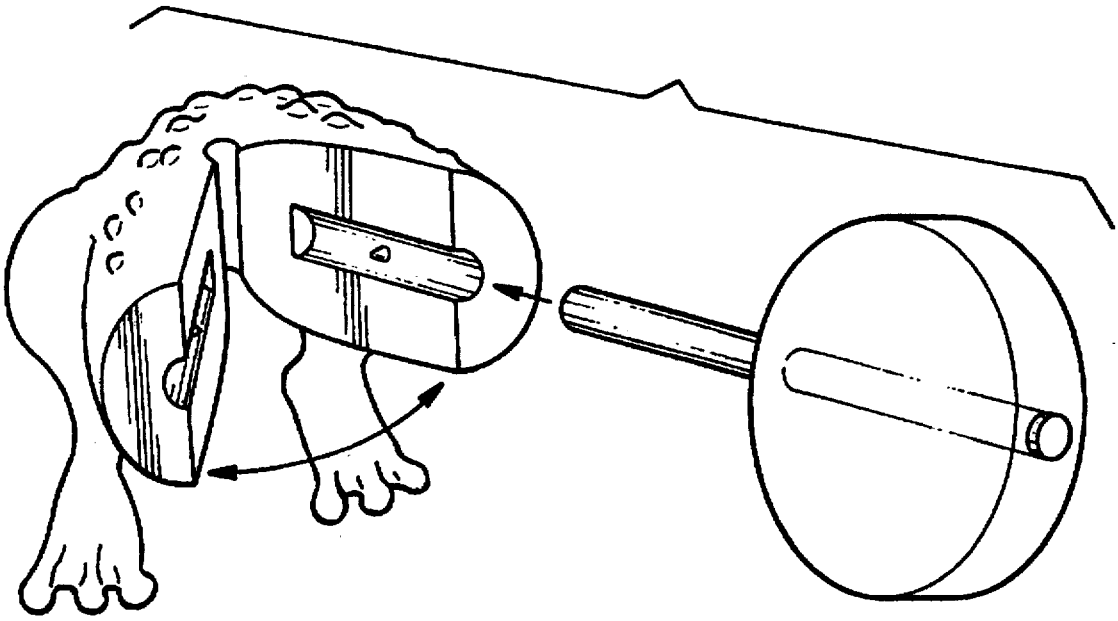
FIG. 7 is an exploded perspective view of an alternative embodiment of the invention illustrating the alternative securing means of a tooth capable of piercing the pre-existing handle of the oral device.

In yet an alternative embodiment shown in FIG. 6, the handle 10, comprising its main body 12, may be formed of clampable halves 24 and 26. In this embodiment, securing means 16 may comprise an abrasive surface disposed on the interior circumference of receiving channel 14 to secure the pre-existing stick handle of a lollipop. In operation, the clampable halves are unclamped, the lollipop stick is placed in appropriate positions within longitudinal receiving channel 14 in the two halves 24 and 26 of main body 12 and the clampable halves are then clamped together, thus securing the lollipop stick within receiving channel 14. In this embodiment, main body 12 is further provided with a childproof locking means 28 to ensure that the clampable halves 24 and 26 remain together. Alternatively, the clampable halves may be hinged at least one point, as with a living hinge, to facilitate keeping the halves together; the locking means 28 would be suitable located, generally opposite the hinge.

In yet another alternative embodiment not shown in the Figures, in which main body 12 is formed of clampable halves 24 and 26, securing means 16 may be one or more sharpened teeth capable of piercing the pre-existing stick handle of the lollipop to secure it within receiving channel 14. Again, in such an embodiment, the main body 12 is further provided with a childproof locking means 28 to ensure that the clampable halves remain together while the handle is in use by the child.

Where the oral device to be used with the subject toy handle is typically supplied with a hard plastic pre-existing handle, there are two acceptable alternatives. First, the receiving channel 14 of the main body 12, along with the securing means 16, may be configured to accept the pre-existing handle. For example, when the pre-existing handle of the pacifier is either a typical half ring or a typical button end, the receiving channel 14 is appropriately shaped to match and accept the shape.

The second alternative which is also acceptable for use with this invention is to modify the pre-existing handle of the oral device, eg., the pacifier, so that it becomes a permanent, deformable but resilient stick shaped similarly to the stick handle of a lollipop. Material such as a rubber or plastic would be suitable as a resiliently deformable yet strong handle that would then be usable with the embodiments of the subject invention described above and illustrative of use with a pre-existing, typical paper stick handle of a lollipop.

The invention has been described in an illustrative manner, and it is to be understood that the terminology which has been used is intended to be in the nature of words of description rather than of limitation.

Many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A handle adapted to receive a pre-existing handle of an oral device comprising:

a main body formed into a shape simulating a portion of a character or an object;

a receiving channel disposed within said main body, said receiving channel being generally frustoconical with the smaller frustoconical end at an interior end of said channel; and securing means disposed within said receiving channel, said securing means comprises a threaded interior circumference of said receiving channel to secure the pre-existing handle of the oral device in said receiving channel.

2. A handle adapted to receive a pre-existing handle of an oral device comprising:

a main body formed of clampable halves, into a shape simulating a portion of a character or an object;

a receiving channel disposed within said main body; and securing means disposed within said receiving channel to secure the pre-existing handle of the oral device in said receiving channel, said securing means comprising at least one sharp tooth capable of piercing the pre-existing handle to secure it, said tooth disposed within interior surface of channel circumference.

3. The handle of claim 2 wherein said clampable halves are hinged.

4. The handle of claim 3 wherein said clampable halves are hinged with a living hinge.

5. A handle adapted to receive a pre-existing handle of an oral device comprising:

a main body formed of clampable halves into a shape simulating a portion of a character or an object;

a receiving channel disposed within said main body; and securing means disposed within said receiving channel to secure the pre-existing handle of the oral device in said receiving channel; and childproof locking means securing said clampable halves together.

6. A handle adapted to receive a pre-existing handle of an oral device comprising:

a main body formed of clampable halves into a shape simulating a portion of a character or an object;

a receiving channel disposed within said main body; and securing means disposed within said receiving channel to secure the pre-existing handle of the oral device in said receiving channel, said securing means comprising an abrasive interior surface disposed on the surface of said receiving channel.

7. The handle of claim 6 wherein said clampable halves are hinged.

8. The handle of claim 7 wherein said clampable halves are hinged with a living hinge.

9. A handle adapted to receive a pre-existing handle of an oral device comprising:

a main body formed of clampable halves into a shape simulating a portion of a character or an object, said main body including childproof locking means securing said clampable halves together;

a receiving channel disposed within said main body, said receiving channel being generally frustoconical with a smaller frustoconical end at an interior end of said channel, whereby the pre-existing handle of the oral device is secured inside said receiving channel and inside said handle; and securing means disposed within said receiving channel to secure the pre-existing handle of the oral device in said receiving channel.

10. A handle assembly for an oral device comprising:

an oral device having a pre-existing handle formed with a locking tongue extended at an angle from a free end of a longitudinal axis of the pre-existing handle; and an add-on handle adapted to receive the pre-existing handle of the oral device, said add-on handle having:

a main body formed into a shape simulating a portion of a character or an object;

a receiving channel disposed within said main body, said receiving channel being a generally cylindrical longitudinal bore within said handle, said longitudinal bore also having longitudinal groove along one portion of said longitudinal bore, a base end of the longitudinal bore having an open arcuate area normal to the bore, whereby the locking tongue is rotated to engage within the open arcuate area to secure the pre-existing handle to said add-on handle.

* * * * *